US006961039B2

(12) United States Patent
Willis

(10) Patent No.: US 6,961,039 B2
(45) Date of Patent: Nov. 1, 2005

(54) METHOD AND APPARATUS FOR SPARKLE REDUCTION BY REACTIVE AND ANTICIPATORY SLEW RATE LIMITING

(75) Inventor: Donald Henry Willis, Indianapolis, IN (US)

(73) Assignee: Thomson Licensing S.A., Boulogne-Billancourt (FR)

( * ) Notice: Subject to any disclaimer, the term of this patent is extended or adjusted under 35 U.S.C. 154(b) by 163 days.

(21) Appl. No.: 10/078,904

(22) Filed: Feb. 19, 2002

(65) Prior Publication Data

US 2003/0156085 A1 Aug. 21, 2003

(51) Int. Cl.[7] ..... G09G 3/36

(52) U.S. Cl. ..... 345/88; 345/89; 345/204; 345/690

(58) Field of Search ..... 345/87–103, 204, 345/690

(56) References Cited

U.S. PATENT DOCUMENTS

| | | | | | |
|---|---|---|---|---|---|
| 5,170,152 | A | * | 12/1992 | Taylor | 345/605 |
| 5,526,060 | A | * | 6/1996 | Raby | 348/663 |
| 5,786,866 | A | * | 7/1998 | Sani et al. | 348/520 |
| 6,344,857 | B1 | * | 2/2002 | Matono et al. | 345/600 |
| 6,359,663 | B1 | * | 3/2002 | Gadeyne et al. | 348/790 |
| 2002/0126079 | A1 | * | 9/2002 | Willis et al. | 345/89 |
| 2002/0126080 | A1 | * | 9/2002 | Willis et al. | 345/89 |
| 2002/0126134 | A1 | * | 9/2002 | Willis et al. | 345/589 |
| 2003/0156091 | A1 | * | 8/2003 | Willis | 345/98 |

FOREIGN PATENT DOCUMENTS

| | | | |
|---|---|---|---|
| EP | 0457497 | * | 11/1991 |
| JP | 08-088770 | * | 4/1996 |

* cited by examiner

*Primary Examiner*—Lun-yi Lao
(74) *Attorney, Agent, or Firm*—Joseph S. Tripoli; Harvey D. Fried; Christine Johnson

(57) ABSTRACT

A circuit (10) for reducing errors due to adjacent pixel interdependence in a liquid crystal display includes a decomposer (12) for dividing an input signal into a plurality of signals having at least a high brightness signal and at least one low brightness signal, a delay match circuit (14) for the high brightness signal to provide a delay high brightness signal, one or more transient conditioner circuits (16 and/or 18) for processing the at least one low brightness signal to provide at least one transient conditioned low brightness signal, and a combiner (20) for combining the delay matched high brightness signal with the at least one transient conditioned low brightness signal to provide an output signal having reduced sparkle artifacts.

16 Claims, 4 Drawing Sheets

10/0

METHOD AND APPARATUS FOR SPARKLE REDUCTION BY REACTIVE AND ANTICIPATORY SLEW RATE LIMITING

CROSS REFERENCE TO RELATED APPLICATIONS (not applicable)

BACKGROUND OF THE INVENTION

1. Field of the Invention

This invention relates to the field of video systems utilizing a liquid crystal display (LCD), and in particular, to video systems utilizing normally white liquid crystal on silicon imagers.

2. Description of Related Art

Liquid Crystal on Silicon (LCOS) can be thought of as one large liquid crystal placed over a silicon wafer. The silicon wafer is divided into an incremental array of tiny plates. A tiny incremental region of the liquid crystal is influenced by the electric field generated by each tiny plate and a common plate. Each such tiny plate and corresponding liquid crystal region are together referred to as a cell of the imager. Each cell corresponds to an individually controllable pixel. Each tiny plate is also a mirror for reflecting back a cell's light. A common plate electrode is disposed on the other side of the liquid crystal.

The drive voltages are supplied to plate electrodes on each side of the LCOS array. In the presently preferred LCOS system to which the inventive arrangements pertain, the common plate is always at a potential of 8 volts. Each of the other plates in the array of tiny plates is operated in two voltage ranges. For positive pictures, the voltage varies between 0 volts and 8 volts. For negative pictures the voltage varies between 8 volts and 16 volts.

The light supplied to the imager, and therefore supplied to each cell of the imager, is field polarized. Incoming light is incident upon the common electrode which is transparent. Each liquid crystal cell rotates the polarization of the input light responsive to the RMS value of the electric field applied to the cell by the plate electrodes. Generally speaking, the cells are not responsive to the polarity (positive or negative) of the applied electric field. Rather, the brightness of each pixel's cell is generally only a function of the rotation of the polarization of the light incident on the cell. Furthermore, polarization rotation for each cell is a non-linear function of the electric field. Polarization rotation for a given cell occurs as the light passes through the liquid crystal both before and after reflection from the cell plate. It is the rotation of the polarization that is capable of being controlled. Light leaving the imager is approximately the same intensity, but a different polarization. This may depend on the intensity that is ultimately desired. It should be noted that it is undesirable to have the imager absorbing light because it can get too hot. The imager will get hot due to some spurious amount of absorption.

If adjacent pixels produce different brightness, then there must be a different potential on the 2 cell plates corresponding to the adjacent pixels. When potentials on adjacent cell plates are unequal, there is an electric field between them which is known as a fringing field. The fringing field has some components, which are orthogonal to the desired field. These orthogonal components are not a problem in the space between adjacent mirrors. But, the orthogonal components of the electric field, which is over the mirror, will have the effect of distorting the polarization rotation. This distortion results in a substantial local increase in brightness. This is a particular problem when the pixel is supposed to be dark, but is usually an insignificant problem when the pixels are intended to be bright since the pixels are not very different in voltage so the fringing field is not that great. Also, for dark pixels, the additional brightness is much more noticeable. Contrast ratio is also very important in making a high quality display. It is very important to achieve sufficient black level. A proportionately larger drive voltage is needed to create a slightly darker image in a normally white display. Often, a large difference in voltage between adjacent pixels is needed. This results in a major fringing field that produces a visible artifact denoted sparkle. Due to the rotational effects of the fringing fields, this phenomenon is also referred to as a declination error in the imager. Sparkle artifacts can be red, blue and/or green, but green is usually the most prominent color.

Because of the particular manufacturing process used for many imagers, horizontally adjacent pixels suffer more from the fringing field problem. Thus, a need exists for overcoming the sparkle problem described above.

SUMMARY

A circuit for reducing declination errors in a liquid crystal display, in accordance with the inventive arrangements, comprises: a decomposer for dividing an input signal into a plurality of signals having at least a high brightness signal and at least one low brightness signal; at least one transient conditioner circuit for reducing declination errors by limiting signal transients between brightness levels in said at least one low brightness signal; a delay match circuit for said high brightness signal; and, means for combining the delayed high brightness signal with said at least one signal transient processed low brightness signal to provide an output signal, wherein said output signal has reduced sparkle artifacts. The at least one transient conditioner can comprise at least one slew rate limiter and at least one finite response filter.

A method for reducing adjacent pixel interdependence in a liquid crystal display, in accordance with the inventive arrangements, comprises the steps of: dividing an input signal into at least a high brightness signal and at least one low brightness signal; slew rate limiting and finite response filtering the at least one low brightness signal to reduce adjacent pixel interdependence by limiting signal transients between brightness levels; delay matching the high brightness signal; and, combining the at least one slew rate limited and finite response filtered low brightness signal and the delayed high brightness signal to form an output signal having reduced sparkle artifacts.

The method can further comprise the step of slew rate limiting dark going transients of the at least one low brightness level signal and finite response filtering bright going transients of the at least one low brightness level signal. The slew rate limiting can be asymmetric.

The method can further comprise the steps of: further dividing the input signal into a medium brightness signal having brightness levels between the high and low brightness level signals; limiting signal transients between brightness levels of the medium brightness signal to further reduce adjacent pixel interdependence; and, combining the slew rate limited and finite response filtered signal with the high and low brightness signals. The medium brightness signal can be slew rate limited and finite response filtered. Different slew rates and different finite filter responses can be applied to the medium and low brightness signals.

DETAILED DESCRIPTION OF THE PREFERRED EMBODIMENTS

Figure 1:
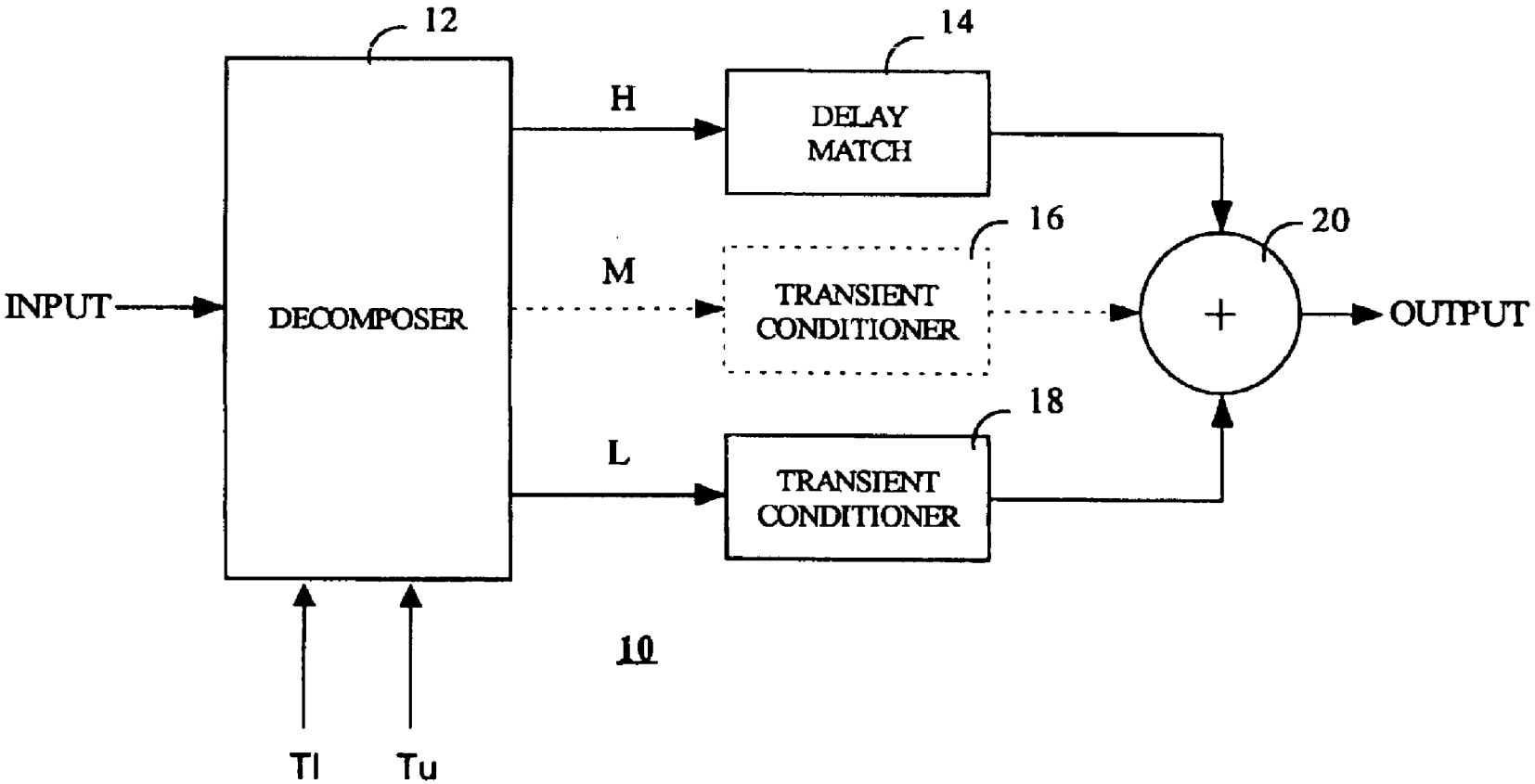
FIG. 1 is a block diagram showing a decomposer, transient conditioners, and a delay match circuit in accordance with the present invention.

Reducing the difference in brightness between adjacent pixels when they are dark, but not when they are bright can resolve the sparkle problem previously described. A device called a decomposer 12 on the input divides the input signal into at least two signals on a circuit 10 used to reduce adjacent pixel interdependence in liquid crystal displays as shown in FIG. 1. It should be understood that Sparkle or declination errors can also be considered a subset of a broader phenomenon known as adjacent pixel interdependence. It should be noted that the present invention is particularly useful for liquid crystal on silicon (LCOS) displays but is not necessarily limited thereto. The decomposer 12 serves as an amplitude discriminator for the input signal which is preferably an eight (8) bit video signal that preferably carries the desired brightness of one color component (Red, Green, or Blue).

The input signal is decomposed in a manner that enables obtaining the original signal when the decomposed or divided signals are added or combined back together. The method in accordance with the present invention would further process the low brightness portion (L and optionally M) and delay match the high brightness portion (H). Then, the signals are recombined and sent to the imager. The same technique can also be applied to the luminance signal (only need one of these decomposed). Accordingly, the improved approach relies upon one decomposer for each color (Red, Green, & Blue). It should be understood that the decomposer can divide the input signal into two or more component signals within contemplation of the present invention.

The decomposer must have at least two inputs, a threshold input and a brightness input signal. If a single threshold is used and the brightness input signal is below the threshold, then the high output is zero (0) and the low output is the brightness input signal itself. If the brightness input signal is above the threshold, then the high output is the brightness input signal minus the threshold input and the low output is the threshold input signal.

Referring once again to FIG. 1, the circuit 10 comprises the decomposer 12 for dividing an input signal into a plurality of signals having at least a high brightness signal (H) and at least one low brightness signal (L). As shown in the embodiment of FIG. 1, the input signal is optionally divided into three (3) signals including a high brightness signal (H), a medium brightness signal (M), and a low brightness signal (L). When the input signal is divided into three signals, two threshold signals (Tu and Tl) are preferably used by the decomposer 12. The circuit 10 further comprises a delay match circuit 14 for processing the high brightness signal to provide a match delayed high brightness signal and at least one transient conditioner (18) circuit for processing the at least one low brightness signal to provide at least one transient conditioned low brightness signal. When the input signal is divided into more than two signals, the "lower" brightness signals (M and L in FIG. 1) are preferably processed using additional transient circuits as needed. In the embodiment shown in FIG. 1, the low brightness signal (L) is processed using the transient conditioner 18 to provide a transient conditioned low brightness signal and a second transient conditioner circuit 16 processes the medium brightness signal to provide a transient conditioned medium brightness signal. The transient conditioners preferably comprise an anticipatory portion and a reactive portion. The transient conditioner circuits preferably comprise at least one recursive slew rate limiter for limiting dark going transients and at least one finite response conditioner or pre-conditioner for limiting bright going transients as will become apparent with reference to FIG. 2. The recursive slew rate limiter is the reactive portion and the finite response pre-conditioner is the anticipatory portion. The circuit 10 also comprises a combiner 20 for combining the processed high brightness signal with the at least one transient conditioned low brightness signal to provide an output signal, wherein the output signal has reduced sparkle artifacts. The combiner 20 of circuit 10 in particular combines the match delayed high brightness signal, the transient conditioned low brightness signal and the transient conditioned medium brightness signal. In this instance, the "at least one transient conditioned low brightness signal" includes both the transient conditioned low brightness signal and the transient conditioned medium brightness signal.

When the decomposer 12 utilizes only a single threshold signal (Tl for example) and the input signal is below the threshold signal, then the high brightness signal is zero and the low brightness signal is the input signal and if the input signal is above the threshold signal, then the high brightness signal is the input signal minus the threshold signal and the low brightness signal is the threshold signal.

If the decomposer 12 includes a lower threshold and an upper threshold, wherein if the input signal is greater than the upper threshold, then the high brightness signal equals the input signal minus the upper threshold, the medium brightness signal equals the upper threshold minus the lower threshold, and the low brightness signal equals the low threshold, and wherein if the input signal is less than the upper threshold but greater than the lower threshold, then the high brightness signal equals zero, the medium brightness signal equals the input signal minus the lower threshold, and the low brightness signal equals the lower threshold, and wherein if the input signal is less than the lower threshold, then the high brightness signal equals zero, the medium brightness signal equals zero, and the low brightness signal equals the input signal. The scenario above where the decomposer 12 divides the input signal into three signals, a high (H), a medium (M), and a low (L) signal, can be summarized as follows:

Tl represents a lower threshold.

Tu represents an upper threshold.

If Input $(I)>Tu$, then $H=I-Tu$, $M=Tu-Tl$, $L=Tl$

If $Tu>I>Tl$, then $H=0$, $M=I-Tl$, $L=Tl$

If $Tl>I$, then $H=0$, $M=0$, and $L=I$

Where $I=L+M+H$

Figure 2:
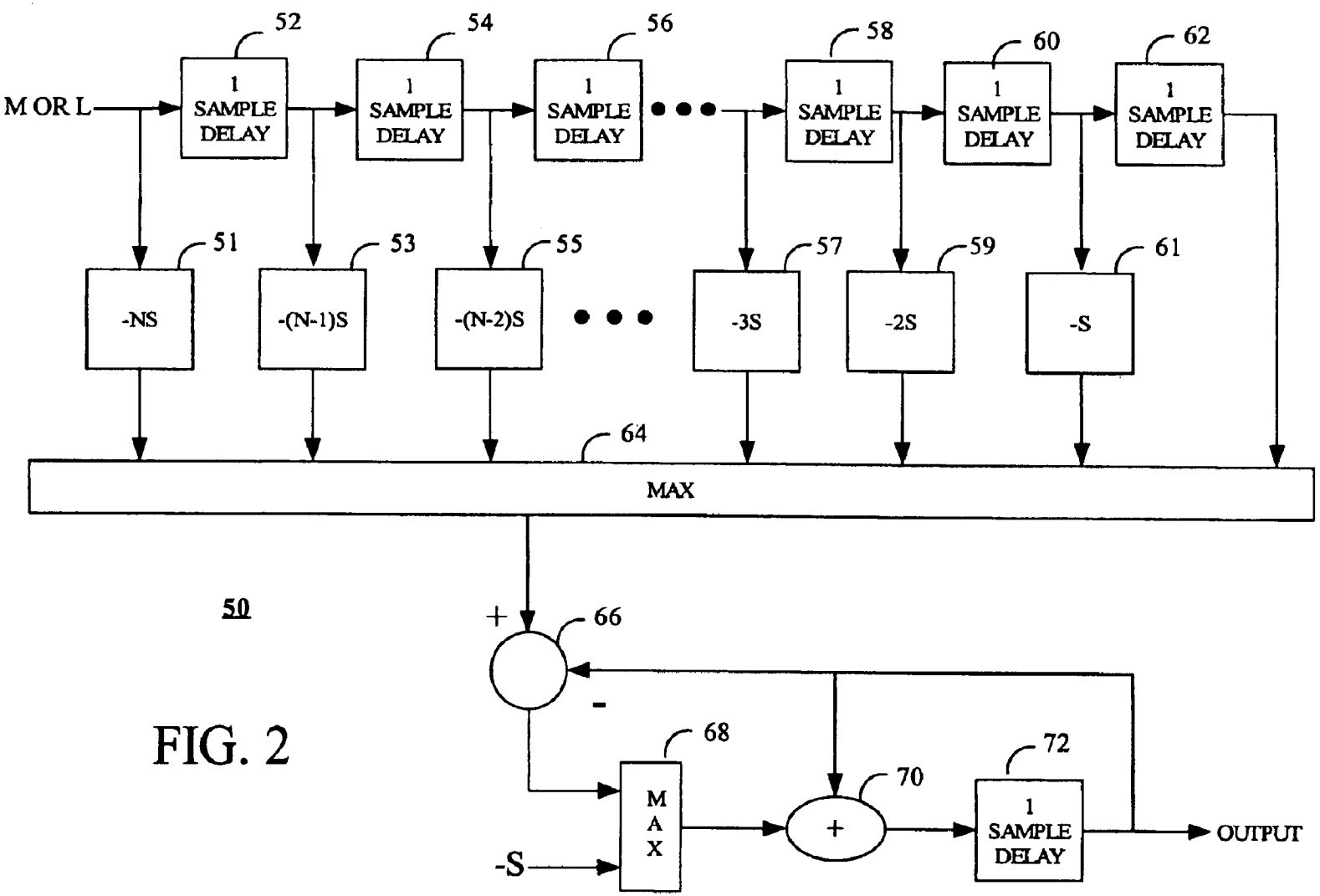
FIG. 2 is a more detailed block diagram showing the transient conditioner in accordance with the present invention.

Referring to FIG. 2, a transient conditioner 50 is shown in accordance with the present invention. The transient conditioner preferably comprises an anticipatory part and a reactive part. The anticipatory part consists of a sample delay line implemented with latches (52, 54, 56, 58, 60, and 62), and with additional processing at each tap (51, 53, 55, 57, 59, and 61). A slew rate value S, is utilized to perform a subtraction at each tap except the output tap. The magnitude of the constant subtracted is proportional to the time delay between that tap and the output. Thus, the second to last tap (61) has S subtracted from its value, the third to last tap (59) has 2S subtracted, the fourth to last tap (57) has 3S subtracted and so on. Then, the maximum (64) of all the resulting values is chosen and passed on. If a high positive value is coming, the output signal is prepared for this by starting its increase early, but at no time is the increase in the output from one sample period to the next sample period greater than S. By the time the high value arrives at the output of sample delay 62, it can be safely used unaltered if it is the maximum.

The reactive part of the transient conditioner 50 consists of a simple slew rate limiter, which limits the slew rate of only negative going transients to −S. This consists of a subtracter (66), a MAX circuit 68, an adder 70, and a one-sample-delay latch 72. If the positive input to the subtractor is lower than the output by more than S, then the new output equals the previous output minus S.

The two transient conditioners can advantageously be set to different slew rates. Different positive and negative slew rate limits can also be advantageously selected, although such a selection is not shown in FIG. 2. The threshold or thresholds can also advantageously be independently selected.

Figure 3:
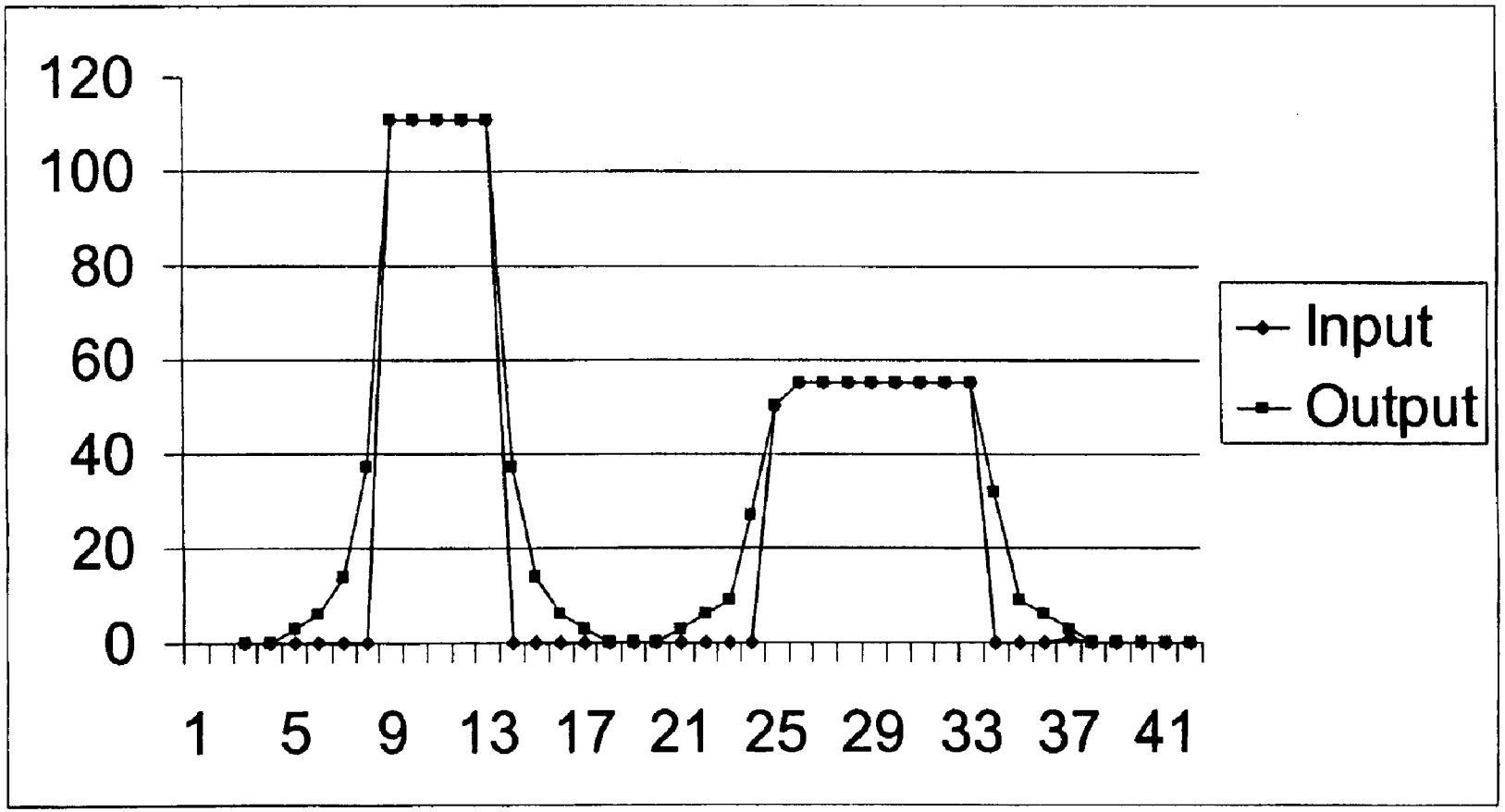
FIG. 3 is a graph illustrating the operation of a system in accordance with the present invention.

Referring to FIG. 3, an example of the operation of a system in accordance with the present invention is shown in the graph. For this example, the upper threshold is 60, the lower threshold is 15, the middle slew limit is 20, and the lower slew limit is 3. In many instances, these values are chosen by trial and error. Too much sparkle correction can cause an undesirably noticeable reduction in resolution, so that the threshold values and the slew rates represent a compromise between reducing declination errors and maintaining picture sharpness.

Figure 4:
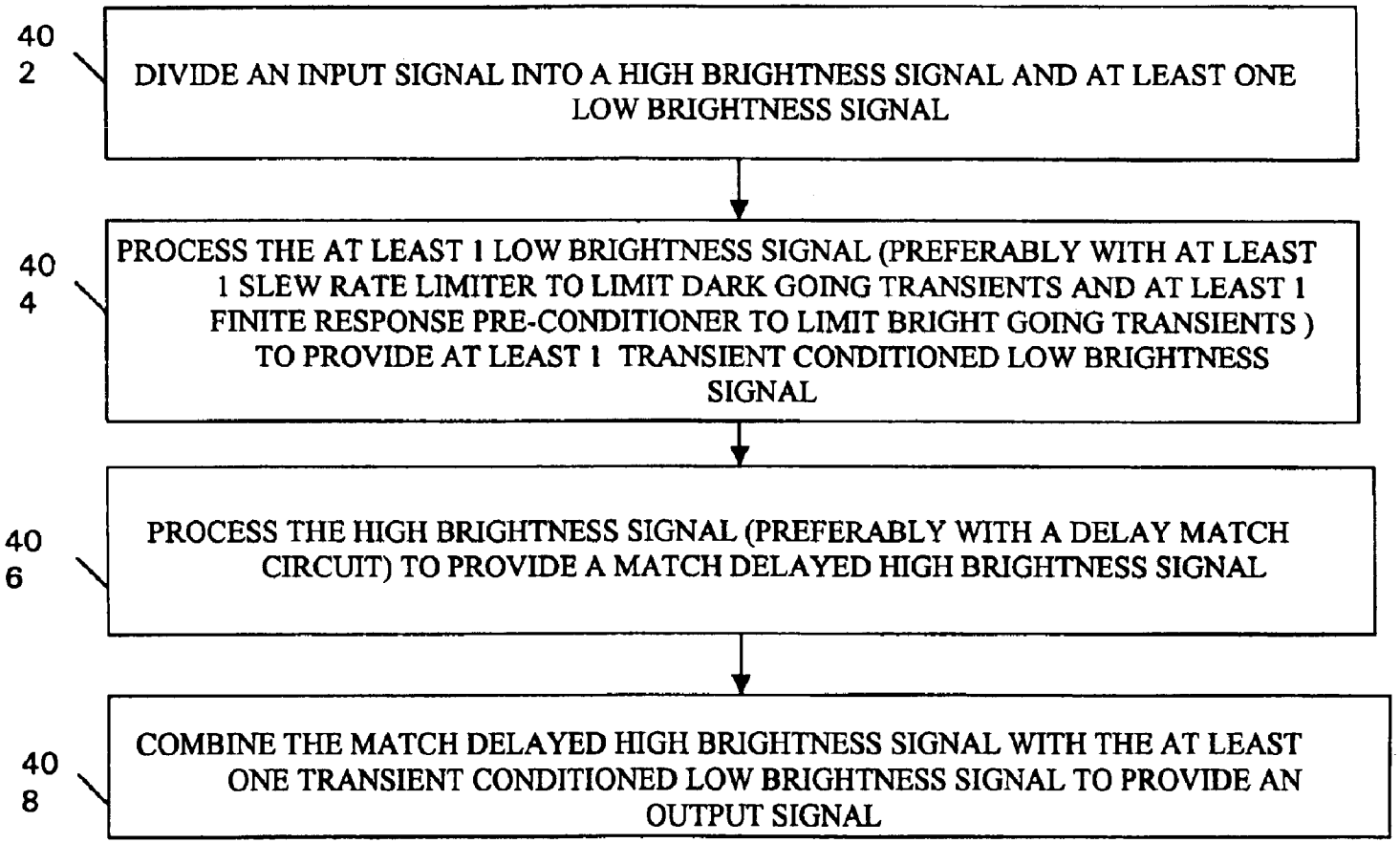
FIG. 4 is a flow chart illustrating a method in accordance with the present invention.

Referring to FIG. 4, a flow chart illustrating a method 400 for reducing adjacent pixel interdependence in a liquid crystal display is shown. The method preferably comprises the steps of dividing (402) an input signal based on the amplitude of the brightness of the input signal into at least a high brightness signal and at least one low brightness signal, processing (404) the at least one low brightness signal preferably with at least one recursive slew rate limiter to limit dark going transients and at least one finite response pre-conditioner to limit bright going transients to provide at least one transient conditioned low brightness signal, and processing (406) the high brightness signal with a sample delay to provide a match delayed high brightness signal. The method further comprises a step 408 of combining the match delayed high brightness signal with the at least one transient conditioned low brightness signal to provide an output signal, wherein the output signal has reduced sparkle artifacts, declination errors or adjacent pixel interdependence. The step of dividing optionally divides the input signal into a high brightness signal, a medium brightness signal, and a low brightness signal wherein the step of processing the high brightness signal comprises delay matching the high brightness signal and wherein the step of processing the at least one low brightness signal comprises transient conditioning the low brightness signal and the medium brightness signal preferably using at least one transient conditioner circuit. The method thus asymmetrically limits the slew rate of predominantly low brightness transients.

Although the present invention has been described in conjunction with the embodiments disclosed herein, it should be understood that the foregoing description is intended to illustrate and not limit the scope of the invention as defined by the claims.

What is claimed is:

1. A circuit for reducing declination errors in a liquid crystal display, comprising:

a decomposer for dividing an input signal into a plurality of signals having at least high, medium and low brightness signals;

at least one transient conditioner circuit including an anticipatory portion and a reactive portion for limiting signal transients between brightness levels in at least one of said medium and low brightness signals;

a delay match circuit for said high brightness signal; and, means for combining the delayed high brightness signal with said at least one signal transient processed brightness signal to provide an output signal, wherein said output signal has reduced sparkle artifacts.

2. The circuit of claim 1, wherein the decomposer divides the input signal into the high brightness signal, a medium brightness signal, and a low brightness signal and the at least one transient conditioner circuit further comprises a second transient conditioner circuit for processing the medium brightness signal to provide a processed medium brightness signal.

3. The circuit of claim 2, wherein the combiner combines the processed high brightness signal, the processed low brightness signal and the processed medium brightness signal.

4. The circuit of claim 1, wherein the decomposer further comprises at least a threshold signal, wherein if the input signal is below the threshold signal, then the processed high brightness signal is zero and the at least one processed low brightness signal is the input signal and wherein if the input signal is above the threshold signal, then the processed high brightness signal is the input signal minus the threshold signal and the at least one processed low brightness signal is the threshold signal.

5. The circuit of claim 2, wherein the decomposer further comprises a lower threshold and an upper threshold, wherein if the input signal is greater than the upper threshold, then the high brightness signal equals the input signal minus the upper threshold, the medium brightness signal equals the upper threshold minus the lower threshold, and the at least one low brightness signal equals the low threshold, and wherein if the input signal is less than the upper threshold but greater than the lower threshold, then the high brightness signal equals zero, the medium brightness signal equals the input signal minus the lower threshold, and the at least one low brightness signal equals the lower threshold, and wherein if the input signal is less than the lower threshold, then the high brightness signal equals zero, the medium brightness signal equals zero, and the at least one low brightness signal equals the input signal.

6. The circuit of claim 1, wherein the liquid crystal display is a liquid crystal on silicon (LCOS) display.

7. The circuit of claim 1, wherein the at least one transient conditioner comprises at least one recursive slew rate limiter.

8. The circuit of claim 1, wherein the at least one transient conditioner comprises at least one finite response pre-conditioner for limiting bright going transients.

9. The circuit of claim 1, wherein the at least one transient conditioner comprises at least one recursive slew rate limiter and at least one finite response pre-conditioner.

10. The circuit of claim 1, wherein the delay match circuit comprises a sample delay circuit.

11. A method for reducing declination errors in a liquid crystal display, comprising the steps of:

dividing an input signal into at least high, medium and low brightness signals limiting, including an anticipatory limiting step and a reactive limiting step, signal transients between brightness levels of at least one of said medium and low brightness signals;

delay matching the high brightness signal; and, combining said at least one limited brightness signal and said delayed high brightness signal to form an output signal having reduced sparkle artifacts.

12. The method of claim 11, wherein the step of limiting includes a step of slew rate limiting dark going transients of said at least one of said medium and low brightness signals and finite response filtering bright going transients of said at least one of said medium and low brightness signals.

13. The method of claim 12, wherein the step of slew rate limiting is carried out asymmetrically.

14. The method of claim 12, wherein the step of limiting is carried out on said medium brightness signal and further comprising the step of:

combining said slew rate limited and finite response filtered signal with said high and low brightness signals.

15. The method of claim 14, comprising the steps of:

slew rate limiting and finite response filtering said medium brightness signal; and, applying different slew rates and different finite filter responses to said medium and low brightness signals.

16. The method of claim 14, comprising the steps of:

slew rate limiting and finite response filtering said medium brightness signal; and, applying different slew rates and different finite filter responses to said medium and low brightness signals.

* * * * *